US007066265B2

(12) United States Patent
Surjaatmadja

(10) Patent No.: US 7,066,265 B2
(45) Date of Patent: Jun. 27, 2006

(54) SYSTEM AND METHOD OF PRODUCTION ENHANCEMENT AND COMPLETION OF A WELL

(75) Inventor: Jim B. Surjaatmadja, Duncan, OK (US)

(73) Assignee: Halliburton energy Services, Inc., Duncan, OK (US)

( * ) Notice: Subject to any disclaimer, the term of this patent is extended or adjusted under 35 U.S.C. 154(b) by 218 days.

(21) Appl. No.: 10/669,859

(22) Filed: Sep. 24, 2003

(65) Prior Publication Data

US 2005/0061508 A1 Mar. 24, 2005

(51) Int. Cl.
*E21B 43/26* (2006.01)
*E21B 43/14* (2006.01)

(52) U.S. Cl. ..... 166/308.1; 166/306; 166/313; 166/297; 166/191

(58) Field of Classification Search ..... 166/305.1, 166/308.1, 387, 191, 123, 306, 297, 313
See application file for complete search history.

(56) References Cited

U.S. PATENT DOCUMENTS 3,323,361 A * 6/1967 Lebourg ..... 73/152.23
3,361,204 A * 1/1968 Howard et al. ..... 166/290
3,430,701 A * 3/1969 Canada ..... 166/269
3,447,607 A * 6/1969 Harris et al. ..... 166/278
3,865,188 A 2/1975 Doggett et al.
4,671,352 A * 6/1987 Magee et al. ..... 166/186
4,714,117 A * 12/1987 Dech ..... 166/380
5,103,911 A * 4/1992 Heijnen ..... 166/297
5,295,393 A * 3/1994 Thiercelin ..... 73/152.51
5,533,571 A 7/1996 Surjaatmadja et al.
5,765,642 A 6/1998 Surjaatmadja
6,286,600 B1 9/2001 Hall et al.
6,832,654 B1 * 12/2004 Ravensbergen et al. . 166/308.1

FOREIGN PATENT DOCUMENTS

EP 1 094 195 A2 4/2001

* cited by examiner

*Primary Examiner*—Kenneth Thompson
(74) *Attorney, Agent, or Firm*—John W. Wustenberg; Baker Botts L.L.P.

(57) ABSTRACT

A method of treating and completing a well includes positioning a downhole tool within a well. The downhole tool includes an elongated body defining a central passageway and including a plurality of production openings and at least one frac opening, a frac mandrel disposed within the central passageway, and a packer disposed about the elongated body. The method further includes securing the downhole tool in the well by the packer, fracing a formation through the frac opening, and producing a fluid from the formation through the production openings.

33 Claims, 7 Drawing Sheets

SYSTEM AND METHOD OF PRODUCTION ENHANCEMENT AND COMPLETION OF A WELL

BACKGROUND

The present invention relates generally to methods and apparatuses for treating and completing a well and, more particularly, to a system and method of production enhancement and completion of a well.

In preparing a subterranean formation for production after drilling a well, a packer or plug is often used to isolate zones of the wellbore. Packers and plugs are selectively expandable downhole devices that prevent or control the flow of fluids from one area of the wellbore to another. For example, during production enhancement operations, such as hydraulic fracturing (fracing), a packer may be used to direct acid, a fracturing fluid, or other process fluid into a desired zone while isolating the remaining zones of the wellbore from the process fluid. A well may also be cased or otherwise completed after drilling. For example, in low integrity formations or high productivity fields, wells may be lined with production liners. Other production enhancement operations may also be performed. These completion and production enhancement operations typically require multiple trips into the well.

SUMMARY

In a particular embodiment of the invention, a downhole tool system for single step completing, fracturing, and fracpacking a well is provided for use in completion and production enhancement of oil, gas, and other wells.

In accordance with a particular embodiment, a method of treating and completing a well includes positioning a downhole tool within the well. The downhole tool includes an elongated body defining a central passageway and including a plurality of production openings and at least one frac opening, a frac mandrel disposed within the central passageway, and a packer disposed about the elongated body. The method further includes securing the downhole tool in the well by the packer, fracing a formation through the frac opening, and producing a fluid from the formation through the production openings.

Technical advantages of one or more embodiments of the downhole tool system include completing, fracturing, and fracpacking a well in a single trip down the well. This saves considerable time and money when completing and/or preparing a well for production. The downhole tool system may be used for low integrity formations to prevent sluffing or collapse of the well near any fractures and/or may be used for high productivity fields to significantly enhance productivity and profitability.

Another technical advantage is securing the downhole tool system within the well using fluid inflatable packers, which may be inflated using frac fluids. In addition, the downhole tool may include a window sleeve that opens to allow fracing and closes to prevent sand and other particles from entering the inside of the downhole tool.

Other advantages include providing a tool that may be permanently set or retrievable from the well, and the use of a common setting tool for setting a liner hanger and controlling the window sleeve and packers.

Various embodiments of the downhole tool and method may include all, some, or none of the above or elsewhere described advantages. Moreover, other technical advantages may be readily apparent from the following figures, descriptions, and claims.

DETAILED DESCRIPTION

Figure 1:
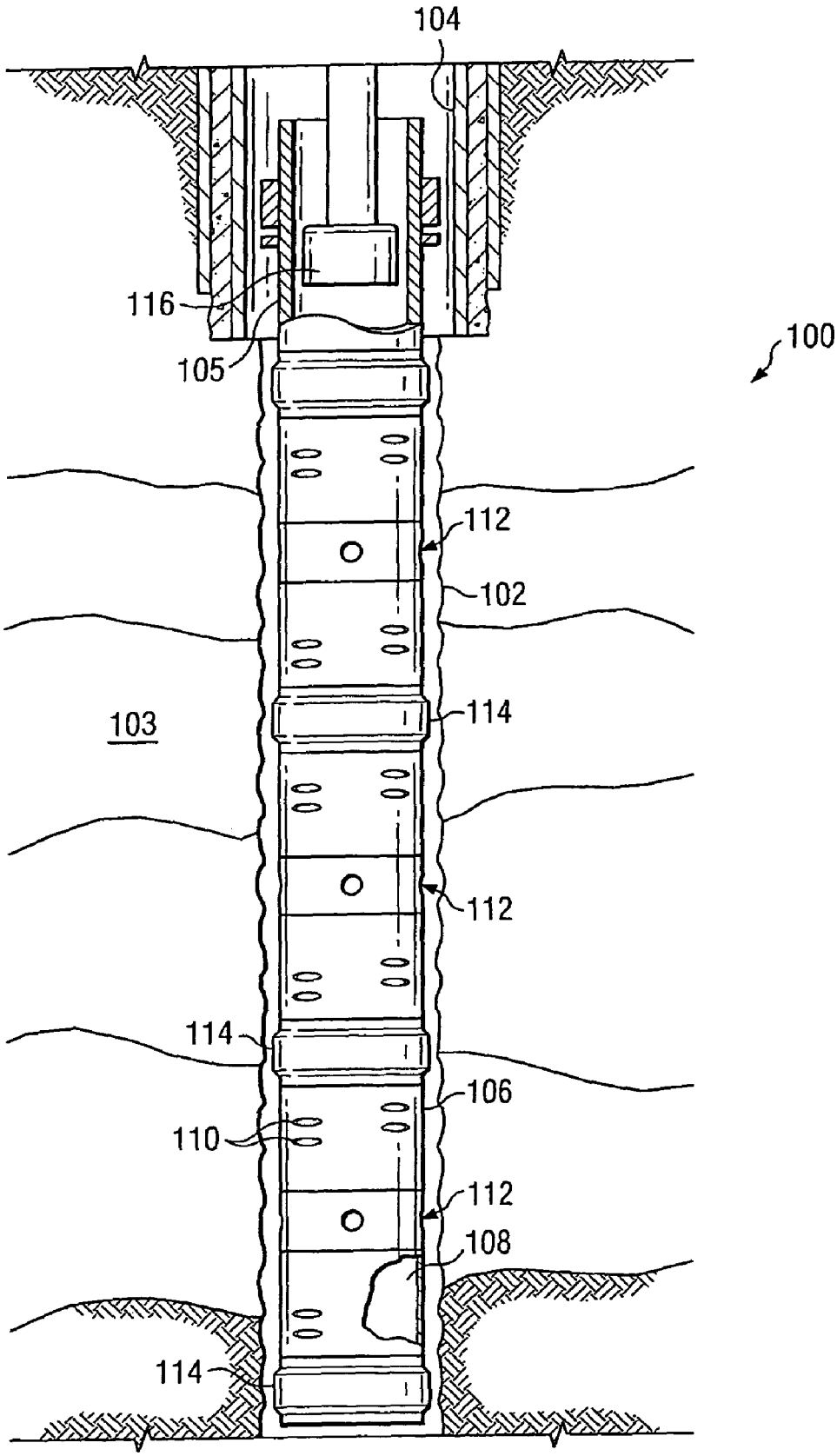
FIG. 1 illustrates a downhole tool disposed within a well according to one embodiment of the present invention.

FIG. 1 illustrates a downhole tool 100 disposed within a well 102 according to one embodiment of the present invention. Well 102 may be any suitable well, such as an openhole well or a cased well cased with a casing 104. Although illustrated in FIG. 1 as being vertical, well 102 may also be horizontal, angled, or oriented in any suitable manner.

As described in further detail below, downhole tool 100 facilitates completing, production enhancing, fracturing, and/or fracpacking well 102 with only one trip, or a reduced number of trips, into well 102. A single step process saves considerable time for the completion of a well, especially a deep well, resulting in considerable cost savings for the well's producer. As one example, in deep water applications, installing liner systems, activating packers for future well control, and placing multiple fractures in a wellbore using conventional processes may last many weeks, if not months. This is especially true for openhole fracturing and packing operations. In one embodiment, downhole tool 100 may deliver the above processes in one trip into the well, which completes the completion process in a matter of days.

In the illustrated embodiment, downhole tool 100 includes a liner hanger 105, an elongated body 106 defining a central passageway 108 and having a plurality of production openings 110, a plurality of ported subs 112, a plurality of packers 114, and a frac mandrel 116 disposed within central passageway 108. The present invention contemplates more, less, or different components for downhole tool 100 than those shown in FIG. 1.

Liner hanger 105 may be any suitable liner hanger that functions to hang elongated body 106. Liner hanger 105 may be set at any desired location by using any suitable setting tool that is coupled to frac mandrel 116. In the illustrated embodiment, liner hanger 105 is disposed at the bottom of casing 104. A liner packer (not explicitly shown) may be utilized to secure and seal liner hanger 105 in place.

Elongated body 106 may be any suitable liner, such as a slotted liner or a screen liner that functions to produce a suitable fluid from subterranean formation 103 through production openings 110 formed therein. Production openings 110 may be any suitable size and any suitable shape. Elongated body 106 may be any suitable shape and may be formed from any suitable material. Elongated body 106 couples to liner hanger 105 in any suitable manner. Elongated body 106 may also function to prevent collapsing of well 102, especially for a horizontal well.

Ported sub 112, which is described in greater detail below in conjunction with FIGS. 2A and 2B, generally functions to facilitate the fracturing of formation 103 at desired locations within well 102. Ported subs 112 are also known in the industry as hydrajet fracturing subs or jetting subs. Ported subs 112, which may either be coupled to elongated body 106 or formed integral therewith, have one or more frac jets associated therewith that allows a suitable frac fluid to fracture formation 103. This is described in greater detail below. Ported subs 112 may be spaced apart with any suitable spacing. For example, a spacing between ported subs 112 may be approximately three hundred feet.

Packers 114 may be any suitable packers, such as mechanical packers or inflatable packers. Packers 114 are disposed about elongated body 106 and function to secure downhole tool 100 within well 102 and to separate well 102 into desired sections. Any suitable spacing may be used for packers 114; however, in a particular embodiment, packers 114 are disposed on either side of each ported sub 112 to isolate particular zones of well 102.

Frac mandrel 116 is disposed within central passageway 108 and facilitates the activation and deactivation of packers 114 in addition to facilitating the fracturing of formation 103 by controlling the flow of a frac fluid through frac jets of ported subs 112. Frac mandrel 116 may also function to set liner hanger 105 with a suitable setting tool, as described above, or function to facilitate other suitable production enhancement operations, such as acidizing. Frac mandrel 116 may be formed from any suitable material. Further details of the functions of frac mandrel 116 are described below in conjunction with FIGS. 2A and 2B.

Figure 2A:
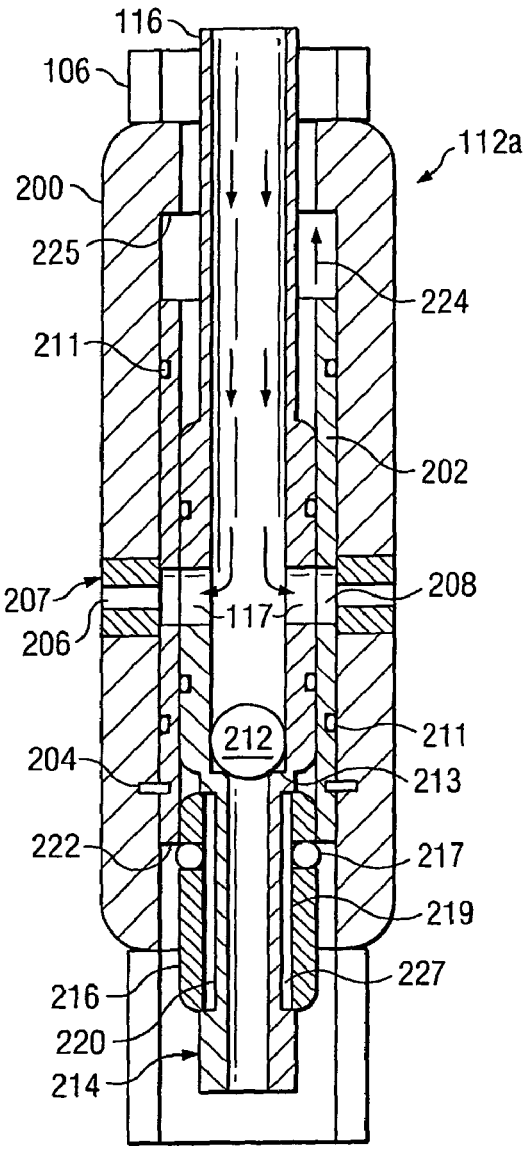
FIG. 2A is a cross-sectional view of one embodiment of a ported sub of the downhole tool of FIG. 1.
Figure 2B:
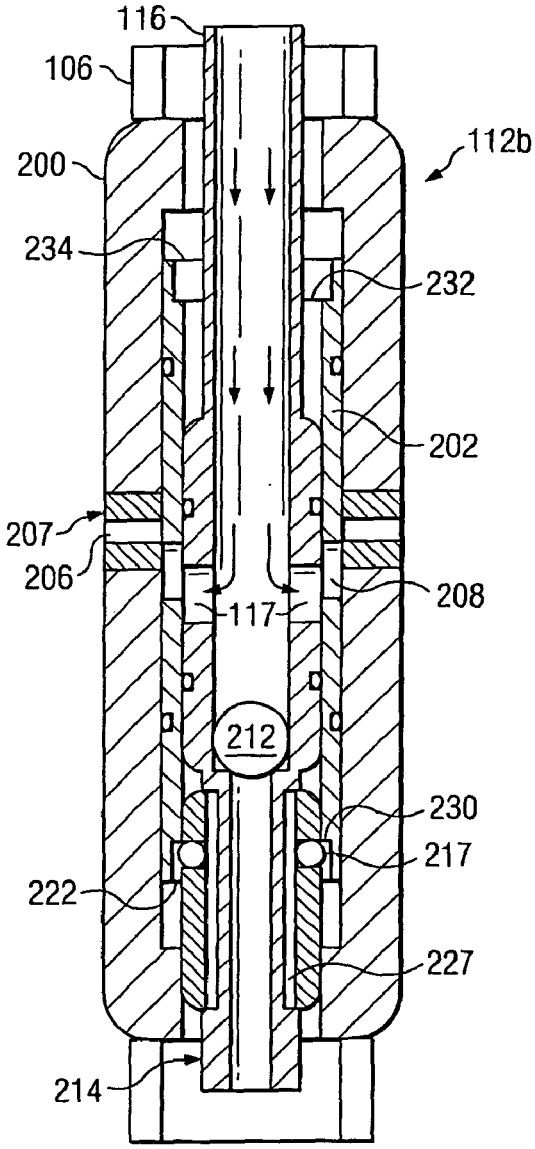
FIG. 2B is a cross-sectional view of another embodiment of a ported sub of the downhole tool of FIG. 1.

FIGS. 2A and 2B are cross-sectional views of two different embodiments of ported sub 112 of downhole tool 100. Generally, FIG. 2A illustrates a single-use ported sub 112 and FIG. 2B illustrates a multiple-use ported sub 112.

Referring to FIG. 2A, ported sub 112*a* includes an outer body 200 and a window sleeve 202 disposed within outer body 200 and coupled to outer body 200 with one or more shear pins 204. Outer body 200 includes a pair of frac openings 206 that each include a frac jet 207. Window sleeve 202 includes a pair of openings 208 that coincide with frac openings 206. Therefore, when frac mandrel 116 is positioned in such a manner that frac openings 206 are aligned with openings 208 and openings 117 in frac mandrel 116, then window sleeve 202 is considered in an "open" position. This open position facilitates the fracturing of formation 103 by flowing a suitable frac fluid down through the passageway within frac mandrel 116 and out openings 117, through openings 208 in window sleeves 202, through frac openings 206, and out frac jets 207 in outer body 200.

Shear pins 204 hold window sleeve 202 in place during the fracturing process. A pair of gaskets 211 may be disposed around an outer perimeter of window sleeve 202 to seal an annular space between window sleeve 202 and outer body 200. This prevents any frac fluid or other process fluid from interfering with the function of frac jets 207. In order to ensure that the frac fluid is directed correctly through frac jets 207, a valve ball 212 is disposed at the end of frac mandrel 116 on a shoulder 213 that is formed by the coupling of a setting tool 214 to the bottom of frac mandrel 116. Details of setting tool 214 are described below. Valve ball 212 forces frac fluid to enter frac openings 206 and flow out through frac jets 207.

After the fracturing process is completed, the circulation of the frac fluid is stopped and window sleeve 202 is moved to a "closed" position. In order to move window sleeve 202 into the closed position, shear pins 204 need to be sheared. This is facilitated by setting tool 214, which in the illustrated embodiment is a drag block type setting tool. Other suitable setting tools, such as a ball type setting tool may also be utilized. Setting tool 214 includes a drag block 216 disposed around an outer perimeter thereof. An outer surface of drag block 216 essentially drags along the inside surface of window sleeve 202.

One or more steel balls 217 are positioned within a circular groove of drag block 216. Steel balls 217 are resting on a first surface 219 of setting tool 214 such that steel balls 217 are engaging an end 222 of window sleeve 202. In this manner, when one pulls up on frac mandrel 116, the engagement of steel balls 217 with end 222 of window sleeve 202 will cause shear pins 204 to shear and thereby move window sleeve 202 upward, as denoted by arrow 224, until resting on a shoulder 225 of outer body 200. This causes openings 208 to be misaligned with frac jets 207, thereby closing any pathway from the inside of frac mandrel 116 to frac jets 207. In order to move drag block 216 within window sleeve 202, an operator merely turns frac mandrel 116 either right or left such that steel balls 217 drop within a longitudinal groove 227 on setting tool 214 so that steel balls 217 engage a second surface 220. This essentially moves steel balls 217 radially inward so that drag block 216 may slide within window sleeve 202.

Thus, ported sub 112*a* as illustrated in FIG. 2A is a single-use ported sub that may be used only once to fracture a formation, such as formation 103. Ported sub 112*a* is installed in the open position and, when fracturing is completed, is permanently moved to the closed position, as described above.

Referring to FIG. 2B, ported sub 112*b* is similar to ported sub 112*a* in FIG. 2A except that ported sub 112*b* may be used to fracture a formation more than one time. This is facilitated by having window sleeve 202 slidably disposed within outer body 200.

Window sleeve 202 is illustrated in FIG. 2B in a "closed" position. Window sleeve 202 is movable between open and closed positions as follows. Steel balls 217 of setting tool 214 engage a shoulder 230 near end 222 of window sleeve 202. As described above, an operator that pulls on frac mandrel 116 may move window sleeve 202 upward until openings 117 and openings 208 are aligned with frac jets 207. Thereafter, a frac fluid may be pumped through the internal passageway of frac mandrel 116 and out through frac jets 207, as described in conjunction with the embodiment of FIG. 2A. After the fracturing operation, window sleeve 202 needs to be closed. Thus, an operator merely turns frac mandrel 116 either to the right or left in order to allow steel balls 217 to fall within groove 227 so that drag block 216 may slide within window sleeve 202. Frac mandrel 116 is pulled up far enough to where steel balls 217 engage a shoulder 232 of an end 234 of window sleeve 202 that is opposite end 222. Frac mandrel 116 is then turned back to its original position so that steel balls 217 may pop back out in order to engage shoulder 232. Frac mandrel 116 is then pushed downward thereby pushing window sleeve 202 into the closed position, as illustrated in FIG. 2B. If further fracturing is required through frac jets 207, the process above is merely repeated.

Figure 3A:
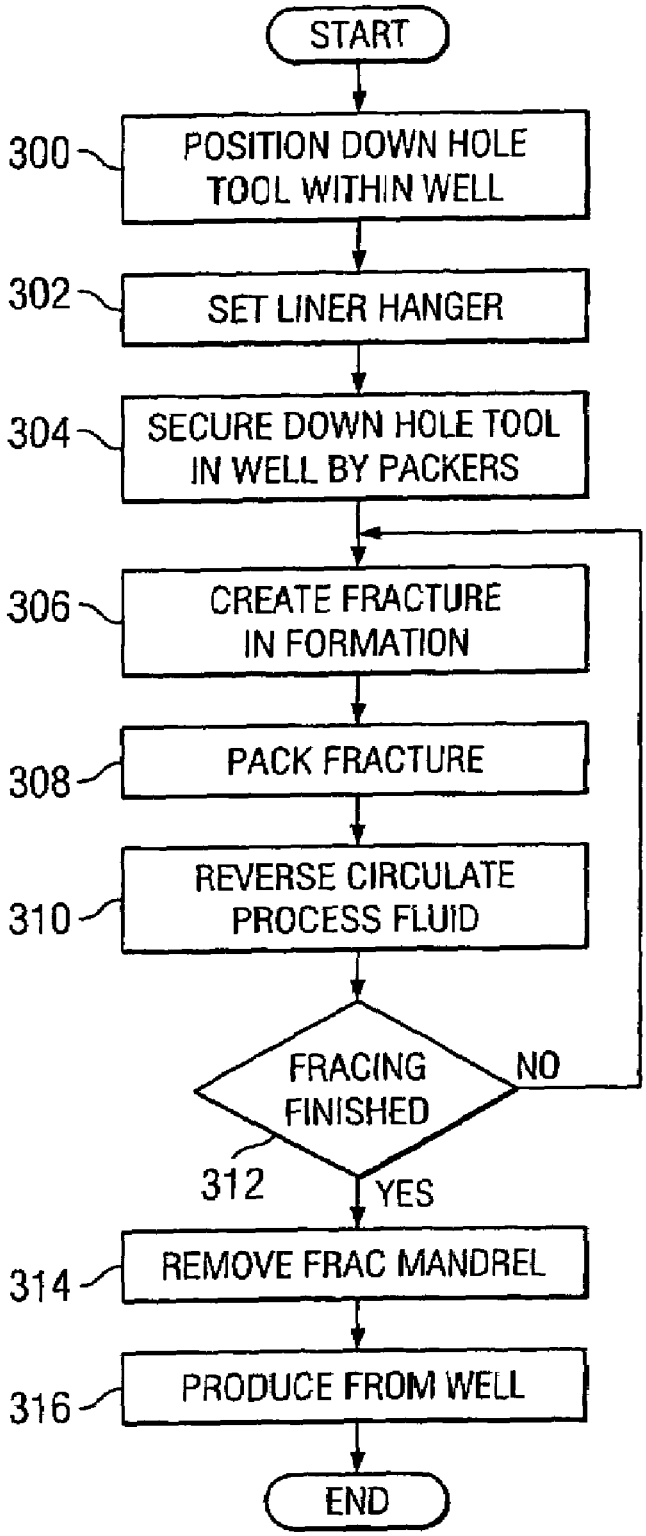
FIG. 3A is a flowchart illustrating a method of completing, fracturing, and fracpacking a well according to one embodiment of the present invention.

FIG. 3A is a flowchart illustrating an example method of completing, fracturing, and fracpacking a well according to one embodiment of the present invention. FIGS. 3B through 3G schematically illustrate this example method.

Figure 3B:
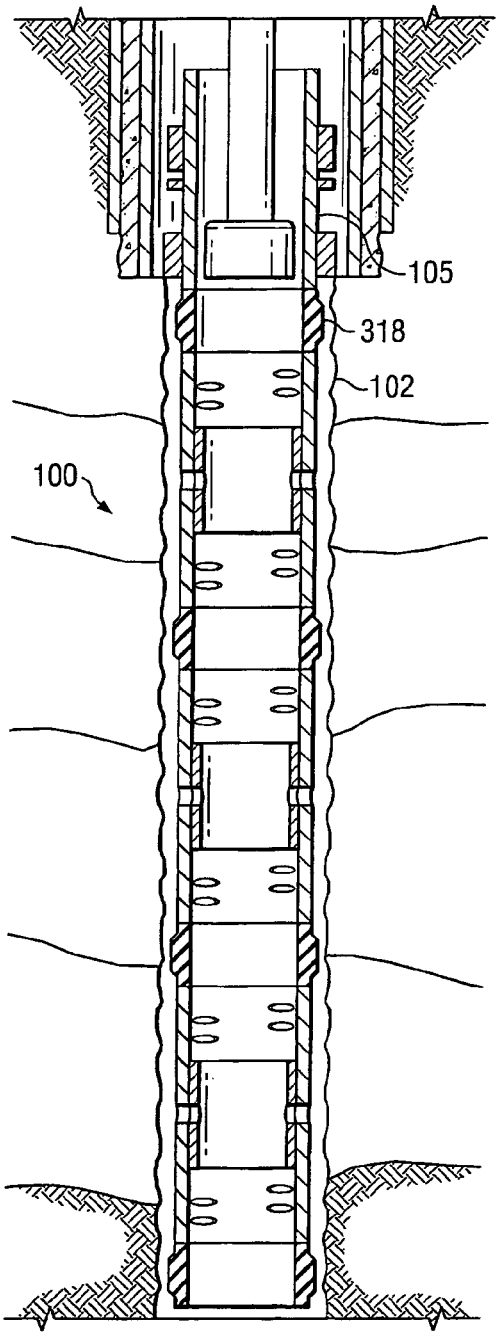
FIGS. 3B through 3G schematically illustrate the method of FIG. 3A.

The example method begins at step 300 where downhole tool 100 is positioned within well 102, as illustrated in FIG. 1. Although not required, a liner hanger 105 may be set within well 102, as denoted by step 302. The setting of liner hanger 105 is illustrated in FIG. 3B. Liner hanger 105 may be sealed with a packer 318. Any suitable liner packer may be utilized for packer 318. In a particular embodiment, packer 318 may be an inflatable packer.

Figure 3C:
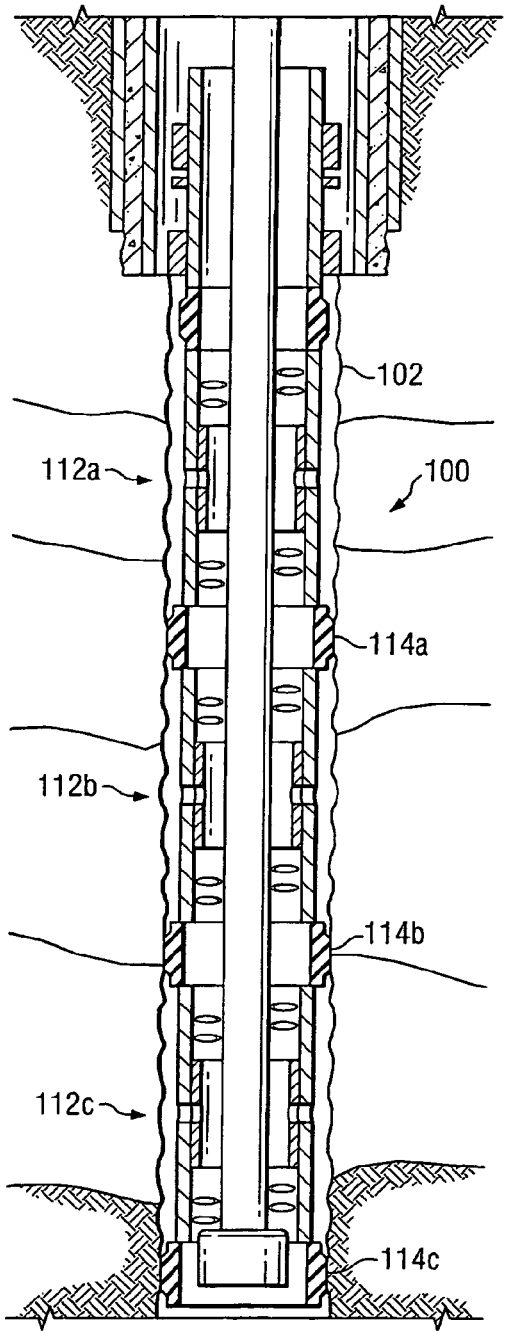

Downhole tool 100 is then secured and sectionalized in well 102 by packers 114, as denoted by step 304. This is illustrated in FIG. 3C in which three separate packers 114*a*, 114*b*, and 114*c* are illustrated. As described above, packers 114 may be any suitable mechanical or inflatable packers. As an example of setting packers 114, downhole tool 100 is run in hole to a first desired position for packer 114*a*. During the run in hole, an operator will feel a resistance when first ported sub 112*a* is reached. When the operator reaches ported sub 112*a*, a slight turn of downhole tool 100 to the right or to the left will "bypass" ported sub 112*a*. The next resistance felt will be the position for packer 114*a*. Packer 114*a* is then set using frac mandrel 116.

After packer 114*a* is set, downhole tool 100 is run in hole until reaching a second position for packer 114*b*. Again, the operator will feel a resistance when reaching a ported sub 112*b*. The operator would again either turn downhole tool 100 to the right or to the left to bypass ported sub 112*b*. Packer 114*b* would then be set before downhole tool 100 is run in hole until reaching a third desired position. Along the way, downhole tool 100 will reach a ported sub 112*c*. Again, downhole tool 100 will be turned either to the right or to the left to bypass ported sub 112*c* until reaching the desired position for packer 114*c*. Packer 114*c* is then set. This process continues until the final packer 114 is set.

Figure 3D:
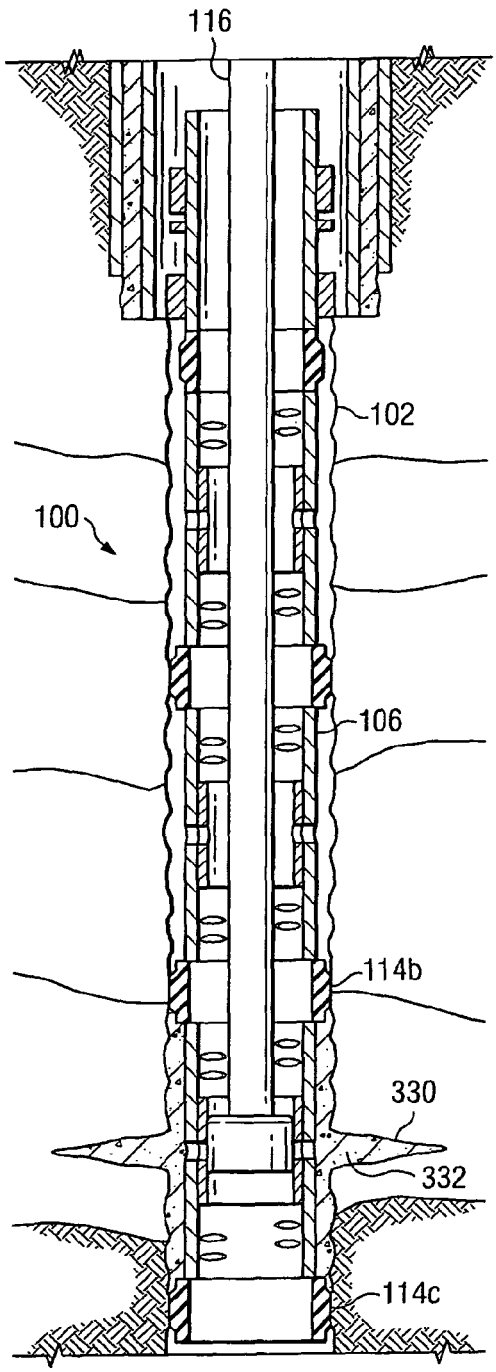

A fracture is then created in formation 103, as denoted by step 306. This is illustrated in FIG. 3D. As illustrated, a first fracture 330 is created in formation 103. The process to create fracture 330 is described above in conjunction with FIGS. 2A and/or 2B. Once the desired length of fracture 330 is obtained, the fracture is packed, as denoted by step 308, with a frac material 332 by reducing a flow of process fluid or fracing fluid through an annulus between elongated body 106 and the wall of well 102. This initiates the tip screenout and starts the packing process. Frac material 332 then fills the fracture 330 and the corresponding annulus between the packers disposed on either side of fracture 330, namely 114*b* and 114*c* in FIG. 3D. After the packing process, the process fluid is reverse circulated, as denoted by step 310 to clean the inside of frac mandrel 116. This reverse circulation is an optional step.

Figure 3E:
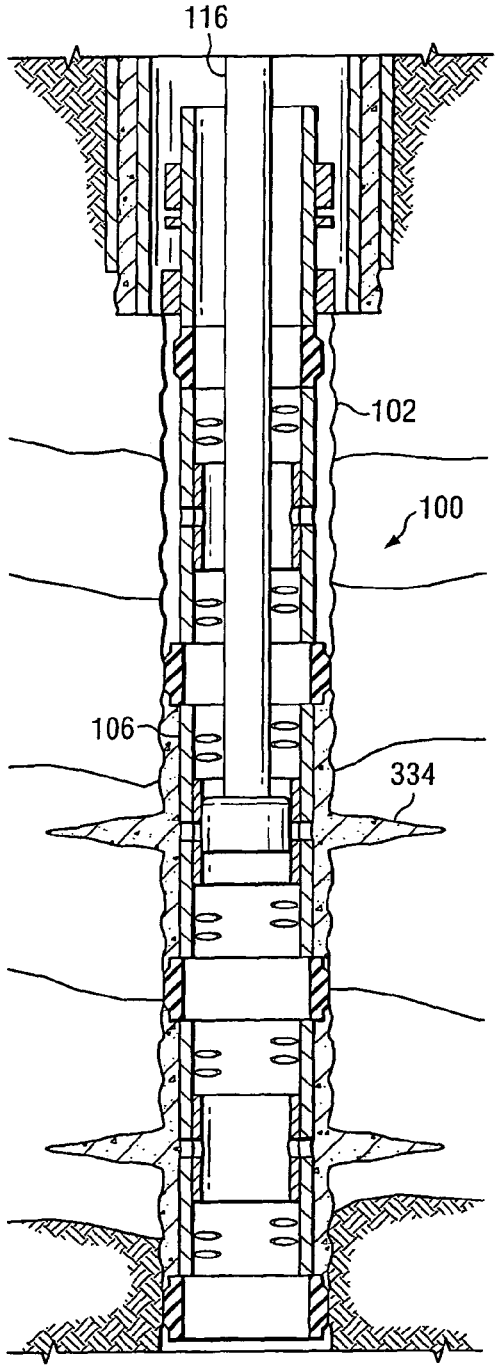

As denoted by decisional step 312, it is determined whether or not the creation of all fractures is finished. If fracing is not finished, then a new fracture 334 is created in formation 103. This is illustrated in FIG. 3E. The process of completing the fracture 330 and packing the fracture 330 as described above applies to fracture 334 also. Again, process fluid may be reverse circulated to clean out frac mandrel 116 before another fracture is created.

Figure 3F:
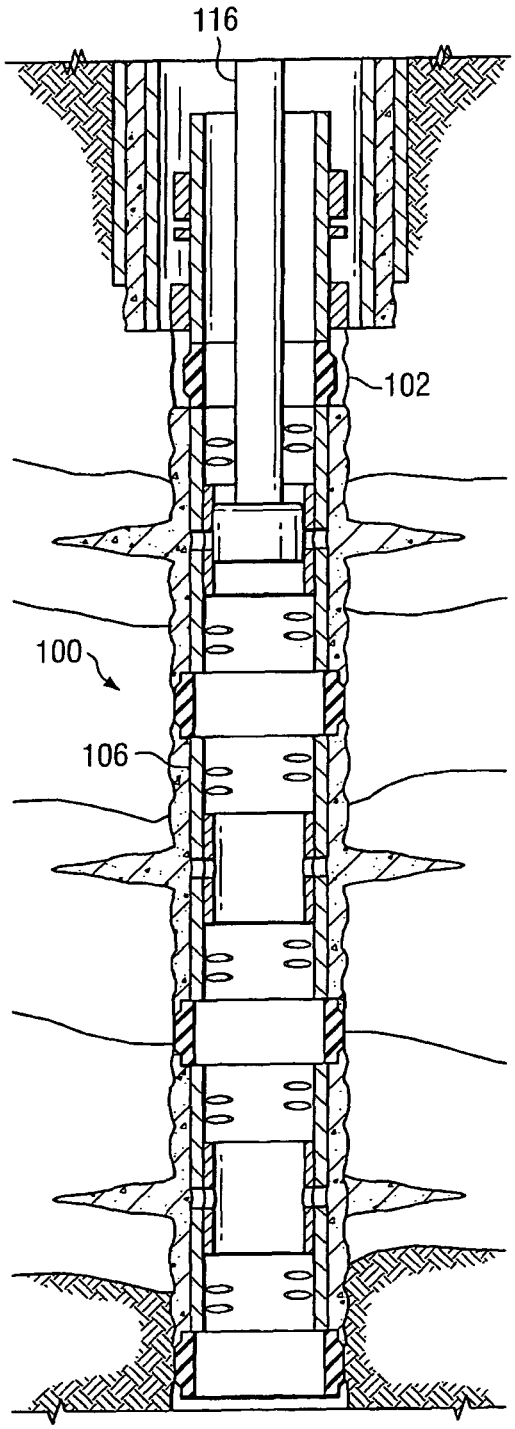
Figure 3G:
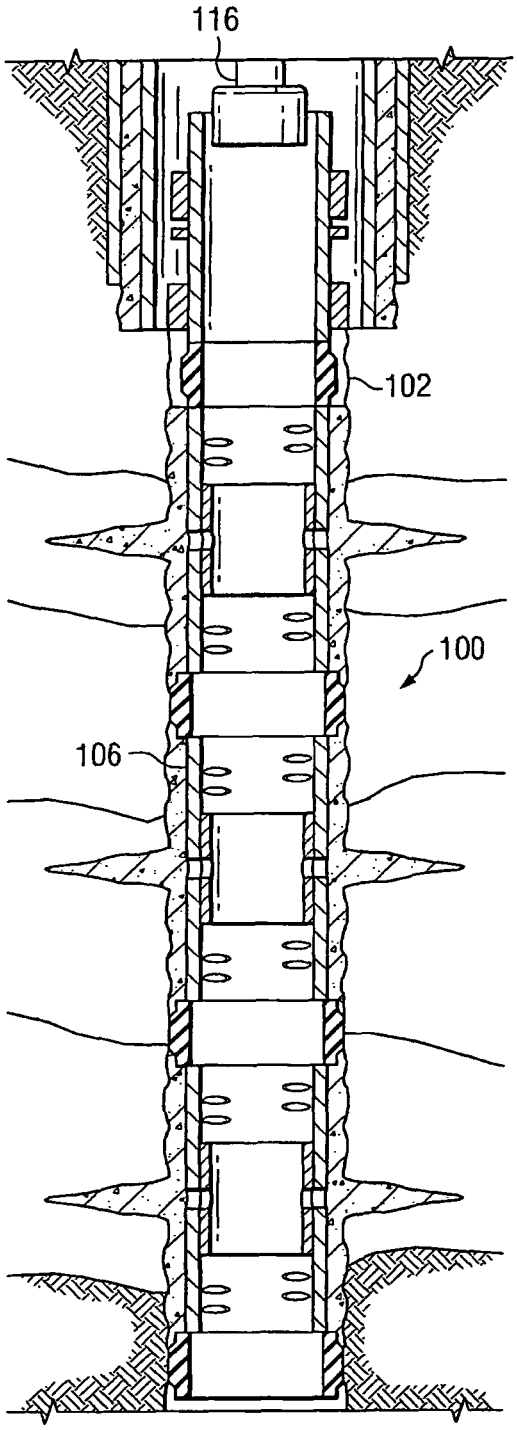

Once the final fracture is created, as illustrated in FIG. 3F, then frac mandrel 116 is removed from elongated body 106 so that the production of fluids from formation 103 may proceed. This is illustrated in FIG. 3G in which frac mandrel 116 is shown above liner hanger 105 as it is being removed. In particular embodiments of the invention, frac mandrel 116 may be designed in such a manner to double up as the production string if so desired. In any event, frac mandrel 116 is removed, as denoted by step 314 and fluids may be produced from well 102, as denoted by step 316. This ends the example method as outlined in FIG. 3A.

Thus, the example method described above illustrates that downhole tool 100 may be used for completing, fracturing, and fracpacking well 102 in a single step during one trip down well 102. This eliminates multiple tripping operations, which saves considerable time and money.

Figure 4:
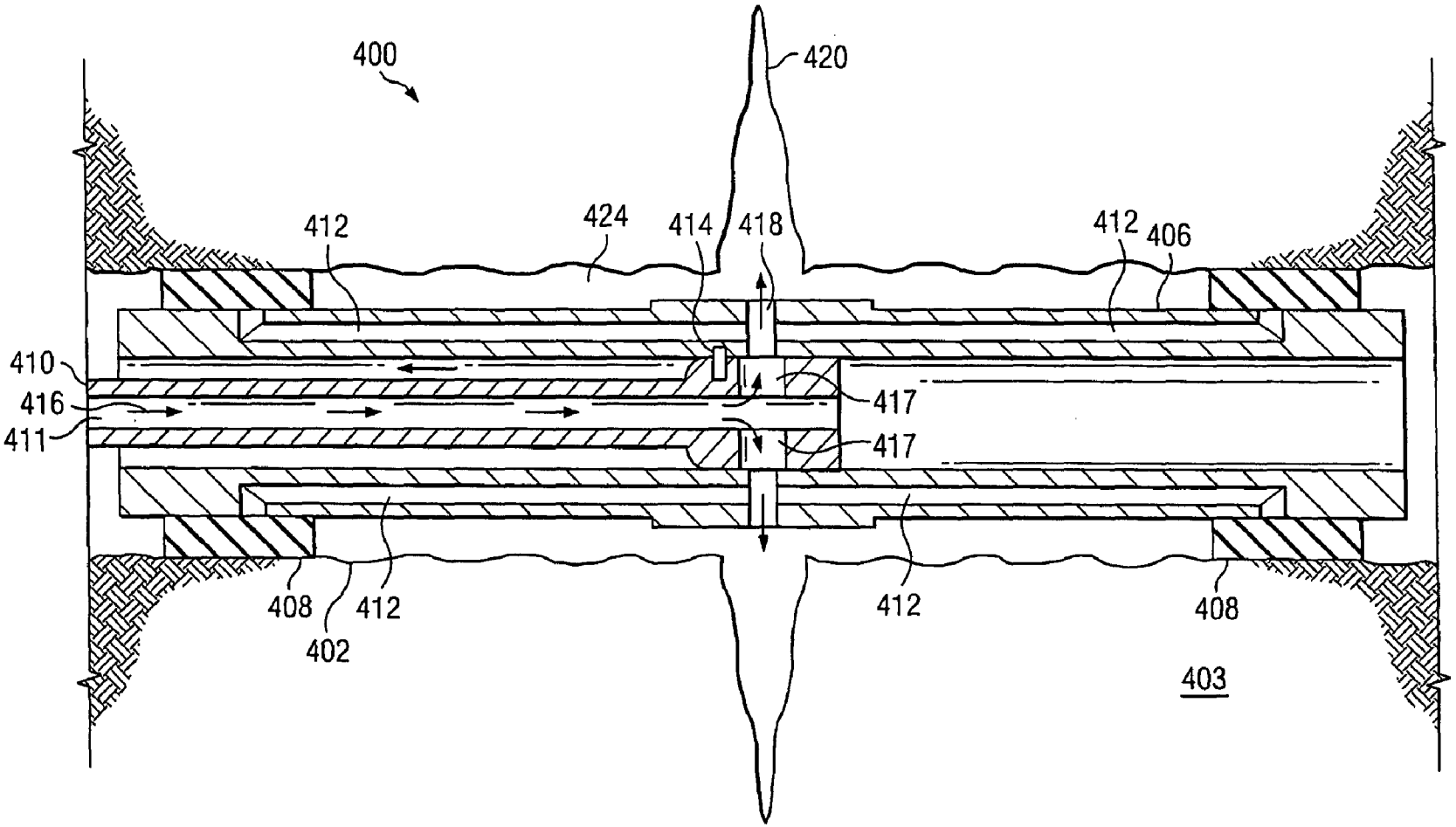
FIG. 4 illustrates a downhole tool disposed within a horizontal well according to another embodiment of the present invention.

FIG. 4 illustrates a downhole tool 400 disposed within a horizontal well 402 according to another embodiment of the present invention. In the illustrated embodiment, well 402 is an openhole well oriented horizontally within a subterranean formation 403. Formation 403 is meant to illustrate a somewhat less competent formation. Downhole tool 400 facilitates convenient placement of a liner system, fracturing of formation 403, packing the fracture, and leaving the liner system in place to prevent sluffing or collapse of well 402 near the fracture.

Accordingly, downhole tool 400 includes an elongated body 406, a pair of inflatable packers 408, and a frac mandrel 410. Elongated body 406 is the liner system that is left in place after the fracturing and fracpacking process is completed to prevent the collapse of well 402, as described above. Any suitable elongated body 406 may be utilized, such as a screened or slotted liner.

Inflatable packers 408 may be any suitable mechanical or inflatable packers. In a particular embodiment, and as illustrated in FIG. 4, packers 408 are sand bags, which are made of a chemically resistive fabric material that allows filtered fluid to move out of the sand bags and leave sand or other suitable proppant behind in the sand bags to inflate them and anchor the elongated body 406 within well 402. The interior of inflatable packers 408 are coupled to an inside passageway 411 of frac mandrel 410 through conduits 412 formed in a wall of elongated body 406. Conduits 412 may be any suitable size and typically consume the pressure energy at rates of less than ten gallons per minute.

Frac mandrel 410 is coupled to the inside surface of elongated body 406 by a shear pin 414 so that downhole tool 400 may be disposed within well 402 in a convenient manner. Frac mandrel 410 may be formed from any suitable material and may be any suitable shape.

In operation of one embodiment of downhole tool 400 illustrated in FIG. 4, downhole tool 400 is run in hole into a desired location. A frac fluid is circulated, as denoted by arrow 416 through passageway 411 of frac mandrel 410 and directed through openings 417 in frac mandrel 410 and frac jets 418 to create a fracture 420 in formation 403. During the fracturing of fracture 420, some of the frac fluid travels through conduits 412 and into packers 408. As described above, the fluid of the frac fluid filters through the sand bags while leaving the proppant behind to fill inflatable packers 408 to anchor elongated body 406 within well 402. Once the desired length of fracture 420 is obtained, the fracpacking process begins by reducing the flow of the frac fluid within annulus 424 between the outside of elongated body 406 and well 402.

When the fracpacking process is finished, an operator pulls frac mandrel 410 upward in order to shear shear pin 414 to release frac mandrel 410 from elongated body 406. Frac mandrel 410 may then be removed from well 402 while leaving elongated body 406 in place adjacent fractures 420. Fluids may then be processed from formation 403.

Although the present invention has been described in several embodiments, various changes and modifications may be suggested to one skilled in the art. It is intended that the present invention encompass such changes and modifications as fall within the scope of the appended claims.

What is claimed is:

1. A downhole tool comprising:

a body defining a passageway and including a plurality of production openings and at least one frac opening;

a packer disposed about the body and operable to secure the downhole tool in a well; and a frac mandrel operable within the passageway, wherein the frac mandrel is operable to facilitate a production enhancement operation through the body and further operable to set the packer.

2. The downhole tool of claim 1 wherein the well is an openhole well.

3. The downhole tool of claim 1 wherein the well is a cased well.

4. The downhole tool of claim 1 wherein the body comprises a liner selected from the group consisting of a slotted liner and a screen liner.

5. The downhole tool of claim 1 wherein the packer comprises two packers disposed about the body and disposed on either side of the frac opening.

6. The downhole tool of claim 1 wherein the packer is an inflatable packer.

7. The downhole tool of claim 6 wherein the frac mandrel is further operable to inflate the inflatable packer with a frac fluid.

8. The downhole tool of claim 1 wherein the frac opening comprises a frac jet.

9. The downhole tool of claim 1 further comprising a sleeve slidably disposed within the passageway, wherein the sleeve is configured to allow a frac fluid to flow through the frac opening when in an open position and to prevent particles from flowing through the frac opening during production of the well when in a closed position.

10. The downhole tool of claim 9 further comprising a setting tool disposed at an end of the frac mandrel, wherein the setting tool is operable to move the sleeve between the open and closed positions.

11. The downhole tool of claim 10 wherein the setting tool is selected from the group consisting of a ball type setting tool and a drag block type setting tool.

12. The downhole tool of claim 1 further comprising a sleeve disposed within the passageway and coupled to the body with a shear pin, wherein the frac mandrel is operable to shear the shear pin to facilitate movement of the sleeve.

13. The downhole tool of claim 1 further comprising a ported sub coupled to the body, wherein the ported sub includes the at least one frac opening.

14. The downhole tool of claim 1 wherein the frac mandrel is coupled to the body with a shear pin, and the frac mandrel is operable to shear the shear pin to facilitate removal of the frac mandrel.

15. The downhole tool of claim 1 wherein the packer comprises two inflatable chambers disposed on either side of the frac opening, and the body includes conduits formed therein to facilitate filling of the inflatable chambers with a material suspended in a frac fluid during fracing.

16. A method of treating a well, comprising the steps of:

positioning a downhole tool within a well, the downhole tool comprising:

a body defining a passageway and including a plurality of production openings and at least one frac opening;

a frac mandrel disposed within the passageway; and a packer disposed about the body;

securing the downhole tool in the well by setting the packer with the frac mandrel; and performing a production enhancement operation through the body.

17. The method of claim 16 further comprising the step of setting a liner hanger with the frac mandrel.

18. The method of claim 16 wherein the step of positioning the downhole tool within the well comprises the step of positioning the downhole tool within an openhole well.

19. The method of claim 16 wherein the step of positioning the downhole tool within the well comprises the step of positioning the downhole tool within a cased well.

20. The method of claim 16 wherein the step of securing the downhole tool in the well comprises the step of securing the downhole tool in the well with two packers disposed on either side of the frac opening.

21. The method of claim 16 wherein the packer is an inflatable packer, and the step of securing the downhole tool in the well comprises the step of inflating the inflatable packer with a frac fluid.

22. The method of claim 16 further comprising the step of selectively causing a frac fluid to flow through the frac opening with a sleeve disposed within the passageway.

23. The method of claim 16 further comprising the step of permanently closing the frac opening with a sleeve coupled to the body with a shear pin by shearing the shear pin to facilitate movement of the sleeve.

24. The method of claim 16 wherein the frac mandrel is coupled to the body with a shear pin, and the method further comprises the step of removing the frac mandrel by shearing the shear pin.

25. The method of claim 16 further comprising the step of producing a fluid from the formation through the production openings.

26. A method of treating and completing a well, comprising the steps of:

positioning a downhole tool within a well, the downhole tool comprising:

a body defining a passageway and including a plurality of production openings and a plurality of frac openings;

a frac mandrel disposed within the passageway;

a setting tool coupled to an end of the frac mandrel; and a plurality of packers disposed about the body;

setting a liner hanger with the setting tool;

securing the downhole tool in the well by setting the packers with the frac mandrel;

successively fracing a formation through respective ones of the frac openings to create a plurality of fractures in the formation at different locations within the well, wherein after each fracing step the method comprises the steps of:

packing the fracture by reducing a flow of process fluid through an annulus between the body and the well; and reversing the circulation of process fluid through the downhole tool;

removing the frac mandrel from the well when finished with the last fracing step; and producing a fluid from the formation through the production openings.

27. The method of claim 26 wherein the step of positioning the downhole tool within the well comprises the step of positioning the downhole tool within an openhole well.

28. The method of claim 26 wherein the step of positioning the downhole tool within the well comprises the step of positioning the downhole tool within a cased well.

29. The method of claim 26 wherein the step of securing the downhole tool in the well comprises the step of disposing packers on either side of each frac opening.

30. The method of claim 26 further comprising the step of selectively causing a frac fluid to flow through respective ones of the frac openings with respective sleeves disposed within the passageway.

31. A method of treating and completing a well formed in a subterranean formation having one or more production zones, comprising the steps of:

positioning a downhole tool within the well, the downhole tool having a body formed with a plurality of frac openings disposed along its length and a plurality of production openings disposed along its length;

securing the downhole tool in the well by one or more packers;

performing a production enhancement operation through the body of the downhole tool, wherein the production enhancement operation includes the step of pumping a fracturing fluid through the body of the downhole tool and out the plurality of frac openings at a sufficient pressure to fracture one or more of the production zones; and producing a fluid from the one or more production zones through the plurality of production openings formed in the body;

wherein at least two of the above steps are performed in one trip into the well.

32. The method of claim 31 further comprising the step of setting a liner hanger.

33. The method of claim 31 wherein the packer is an inflatable packer, and the step of securing the downhole tool in the well comprises the step of inflating the inflatable packer with a frac fluid.

* * * * *